US006629777B2

(12) United States Patent
Tanaka et al.

(10) Patent No.: US 6,629,777 B2
(45) Date of Patent: Oct. 7, 2003

(54) BUFFER PACKING BAG

(75) Inventors: Mikio Tanaka, Tenri (JP); Kazuhiko Hosokawa, Kadoma (JP); Sayuri Nakata, Kadoma (JP); Yoshihito Takechi, Yao (JP)

(73) Assignees: Sun A. Kaken Co., Ltd., Tokyo (JP); Matsushita Electric Industrial Co., Ltd., Osaka (JP); Yamato-Esulon Co., Ltd., Osaka (JP)

( * ) Notice: Subject to any disclaimer, the term of this patent is extended or adjusted under 35 U.S.C. 154(b) by 0 days.

(21) Appl. No.: 09/996,933

(22) Filed: Nov. 30, 2001

(65) Prior Publication Data

US 2002/0064319 A1 May 30, 2002

(30) Foreign Application Priority Data

Nov. 30, 2000 (JP) ..... 2000-363999

(51) Int. Cl.[7] ..... B65D 30/00
(52) U.S. Cl. ..... 383/3; 383/66; 206/522
(58) Field of Search ..... 383/3, 66, 87, 383/37; 206/522

(56) References Cited

U.S. PATENT DOCUMENTS 4,515,840 A * 5/1985 Gatward ..... 229/164.1
4,528,694 A * 7/1985 Skovgaard ..... 383/10
4,826,329 A * 5/1989 Bellini ..... 190/103
5,217,131 A * 6/1993 Andrews ..... 206/522
5,263,587 A * 11/1993 Elkin et al. ..... 206/522
5,427,830 A * 6/1995 Pharo ..... 156/308.4
5,454,642 A * 10/1995 De Luca ..... 206/522
5,826,723 A * 10/1998 Jaszai ..... 206/522
6,334,537 B1 * 1/2002 Tepper ..... 206/315.1

* cited by examiner

*Primary Examiner*—Jes F. Pascua
(74) *Attorney, Agent, or Firm*—Birch, Stewart, Kolasch & Birch, LLP

(57) ABSTRACT

The buffer packing bag comprises an air-supplying passage, which is made of plastic films placed one on another and bonded at desirable spots, and an air-inflatable section formed beside the air-supplying passage, which is divided into individual air-inflatable parts, formed by heat-bonded at multiple spots, and check valves, which allow and stop air flow between each of individual air-inflatable parts and the air-supplying passage, and space-making folds, made in both of the divided portions of the air-inflatable section by heat-bonding to make at least two lines in each portions crossing the individual air-inflatable parts, with the formation to make a loading slit by folding inward from both of the width ends along the length side of the base and heat-bonding both of the overlapped areas of the length sides.

13 Claims, 16 Drawing Sheets

BUFFER PACKING BAG

BACKGROUND OF THE INVENTION

The present invention relates to a buffer packing bag, and more specifically, to a buffer packing bag constituted with cushioning medium of plastic film as generally called wave-like buffering materials, and with a number of individual air-inflatable parts arranged in line.

There have been various sorts of cushioning medium of plastic film like a bag of air-inflatable parts which can be bulged with air through an air inlet and avoid backward air flow under a control of check valves and limited the leakage of air only at damaged air-inflatable parts.

The buffer packing bag made of said cushioning medium is known, as disclosed by Japan Utility Model Publication No.6-35973. It generally looks like an envelope in configuration, which has less space with sufficient depth (height) for containing an article. When the buffer packing bag is bulged with air, the article is hard to be taken in or out of the bag. In particular, the bag is not adaptable as a buffer packing bag for a hard and edgy article like a portable DVD player. Even when an article like that can be taken in to the bag, there still may be a problem to leave the article damaged when transported or when taken in or out of the bag by making a hole on the air-inflatable parts with the corner(s) of the article.

As for the conventional buffer packing bags, some have a flap for sticking attached to the slit, and some do not.

A problem in the first case is that the packing bag is unable to be used as a buffer bag again since the glued flap has to be opened or cut off when the article is taken out. And a problem in the latter case, in transportation, is that the content in the bag is likely to come out of the bag and some other thing(s) can intrude into the bag through the slit.

BRIEF SUMMARY OF THE INVENTION

In order to meet said task and attain said object, the first present invention provides a buffer packing bag with a base of two plastic films, which are placed one on another and heat-bonded at fixed areas and spots. The base of the bag has an air-supplying passage with an air inlet and an air-inflatable section.

The section is divided into multiple individual air-inflatable parts formed in a row beside the air-supplying passage by heat-bonding at several spots crossing between the length sides, and a flat check valve of plastic film in each of the individual air-inflatable parts functioning to allow and stop air flow between each of the individual air-inflatable parts and the air-supplying passage, and an air-flowing space-making fold formed in each of two divided portions of the air-inflatable section along the length sides of the base by heat-bonding partially at each of the individual air-inflatable parts to make at least one line with a uniform interval crossing the individual air-inflatable parts in order to contain an article in the bag.

On the flat base of the bag arranged above, by folding inward from both width sides along the length side of the base and heat-bonding both of the overlapped length sides of the base except for the area of the air inlet of the air-supplying passage, a loading slit for an article appears between both meeting ends of said width sides along the length side of the base.

To consummate the bag, the air-inflatable section is bulged with air let in with pressure at the air inlet through the air-supplying passage.

The second present invention provides a buffer packing bag which has a space-making folds formed by heat-bonding partially at each of the individual air-inflatable parts to make at least one line with a uniform interval.

The third present invention, as defined in the first or second present invention, provides a buffer packing bag which has a bending fold, at which the bag is folded outward to make a loading slit open wide for an article. At least one bending fold is formed eccentrically parallel between the space-making folds in the air-inflatable section and heat-bonded partially to allow air flow in each of the individual air-inflatable parts.

The fourth invention, as defined in any of the first to third invention, provides a buffer packing bag which has a loading slit for an article formed by folding inward from both width sides along the length side of the base to overlap one another and heat-bonding both of the overlapped length sides of the base.

The fifth present invention, as defined in the fourth invention, provides a buffer packing bag which has a flat flap formed at the outer edge of the base folded inward from both width sides in order to cover the inner edge of the base by an adhesive layer provided on the inner surface of the flap.

The sixth present invention, as defined in the fifth invention, provides a buffer packing bag which has a flat flap being a part of the flat base of the bag and made to have a space by heat-bonded of the air-inflatable section.

The seventh present invention, as defined in the fifth invention, provides a buffer packing bag which has a transcription layer formed on the top of the adhesive layer which is provided on the flap.

The eighth invention, as defined in the seventh invention, provides a buffer packing bag which has a transcription layer consisted of any of either sheet or film material or a printed layer which is printed directly on the base, wherein a part or whole of the transcription layer is removed and attached to the adhesive layer on the flap when the loading slit is opened after the flap covers the slit by attaching to the transcription layer.

The ninth invention, as defined in the eighth invention, provides a buffer packing bag which has a transcription layer of said sheet or film material, which is formed by a multi-layer material for ply separation purpose.

The tenth invention, as defined in any of the first to third invention, provides a buffer packing bag which has a loading slit for an article formed by folding inward from both width sides along the length side of the base in order to almost touch each other and heat-bonding both of the overlapped length sides of the base.

The eleventh invention, as defined in any of the first to third invention, provides a buffer packing bag which has a loading slit for an article by folding inward from both width sides along the length side of the base in order to oppose each other and heat-bonding both of the overlapped length sides of the base.

The twelfth invention, as defined in the first invention, provides a buffer packing bag which has a base of the buffer packing bag constituted by a transparent or translucent plastic film.

The thirteenth invention provides a buffer packing bag which has a containing space consisted of two portions, the first and second one, wherein each of the portions shapes like a pocket with an opening which is a part of each other to meet, and the first portions contains a article inside before the second portions moves to meet the opening of the first portions to contain the rest part of the article, and both of the first and second portions is formed by the base of plastic films place one on another and heat-bonded at fixed area and spots, which has multiple individual air-inflatable parts formed by heat-bonding at multiple spots to be bulged with air, and a bending fold is formed at the opening edge of each portions which are a part of them each other, to allow air flow.

The first and second portions as mentioned above the pocket-like parts divided by a loading slit. The containing space refers to the inside of both portions. The opening refers to the opening of the pocket-like parts of the first and second portions facing a loading slit.

Figure 1:
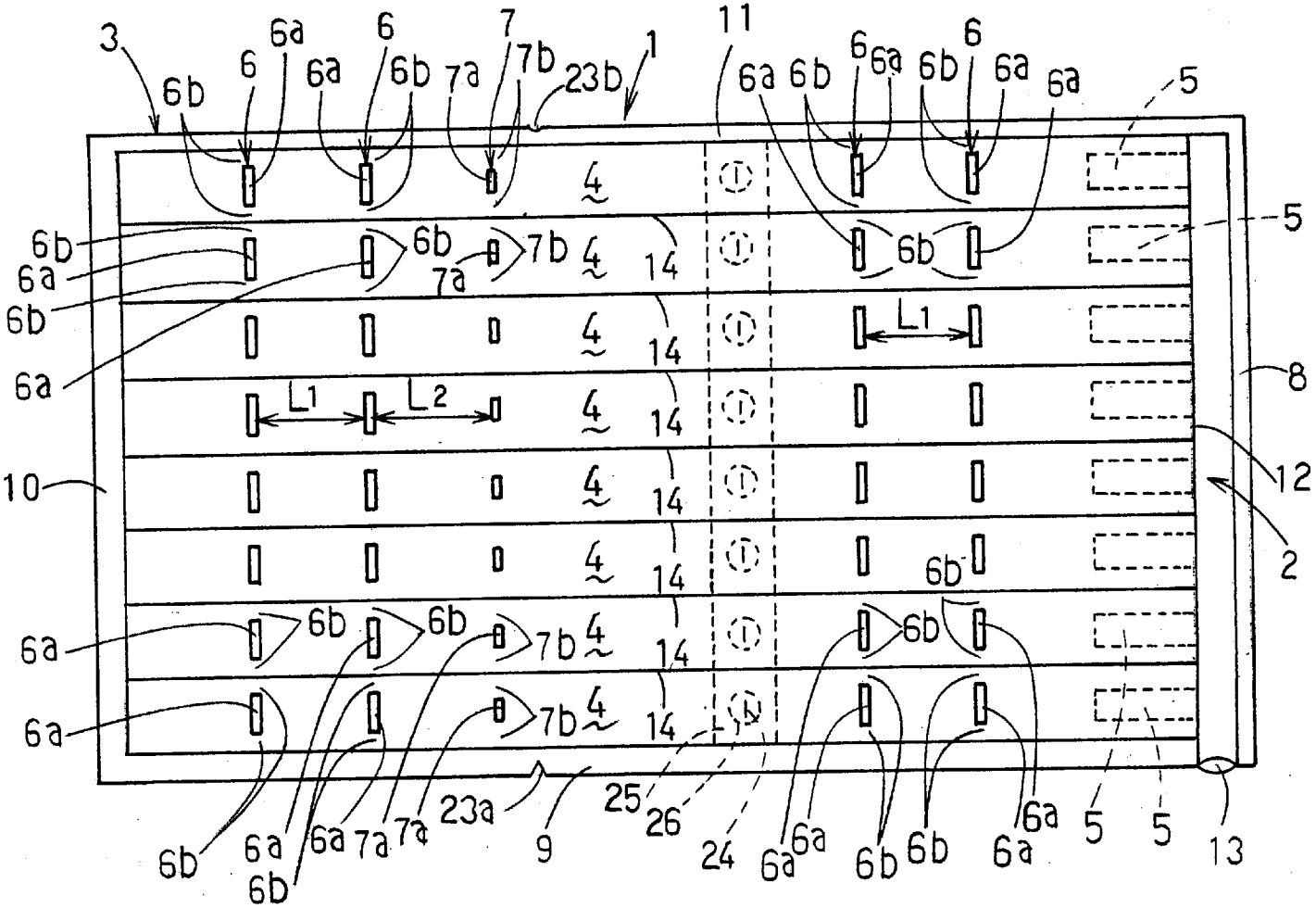
FIG. 1 is a plan view of the base of the buffer packing bag, an embodiment of the present invention.

DETAILED DESCRIPTION OF THE PREFERRED EMBODIMENTS (Embodiment 1)

In the description of the preferred embodiments of the present invention with reference to the accompanied drawings, the reference numeral 1 designates a base of the buffer packing bag. In this embodiment, the base 1, made of two rectangular hot-adherent plastic film sheets of the same size by heat-bonding together at the fixed area and spots, has a flat air-supplying passage 2 and an air-inflatable section 3, formed beside the air-supplying passage 2 along the air-supplying direction.

The air-inflatable section 3 is divided into multiple individual air-inflatable parts 4, and a check valve 5, which is made of plastic film and attached inside to each of said individual air-inflatable parts 4, and two space-making folds 6 functioning to automatically form a box-shaped space with desirable depth (height) for an article when the bag is bulged with air, and a bending fold 7 functioning to fold the base outward and have a loading slit, as mentioned thereinafter, open for an article.

In this connection, while the two rectangular plastic film sheets placed one on another are heat-bonded along the areas 8, 9, 10, 11, the air-supplying passage 2 is formed between a heat-bonded area 8 on one of the width sides of the base 1 and a narrow heat-bonded area 12, which is formed slightly away from the inner side of the heat-bonded area 8, and between the heat-bonded areas 8, 12, a narrow flat-tubular air inlet 13 is formed at one end.

With this embodiment, the heat-bonded area 9 on the same side of the air inlet 13 is made somewhat wider than the other heat-bonded areas 8, 10, 11 for the reason as described later.

The heat-bonded area 12 is arranged to allow air flow between each of the individual air-inflatable parts 4—4.

The individual air-inflatable parts 4—4 are the partitions of the air-inflatable section 3 and formed by heat-bonded lines 14—14 parallel to each other along the direction across the air-supplying passage 2. A check valve 5, as mentioned thereinafter, is attached inside to each of the individual air-inflatable parts 4—4 in order to allow air flow between each of the air-inflatable parts 4—4 and the air-supplying passage 2 only via a check valve 5.

Figure 7:
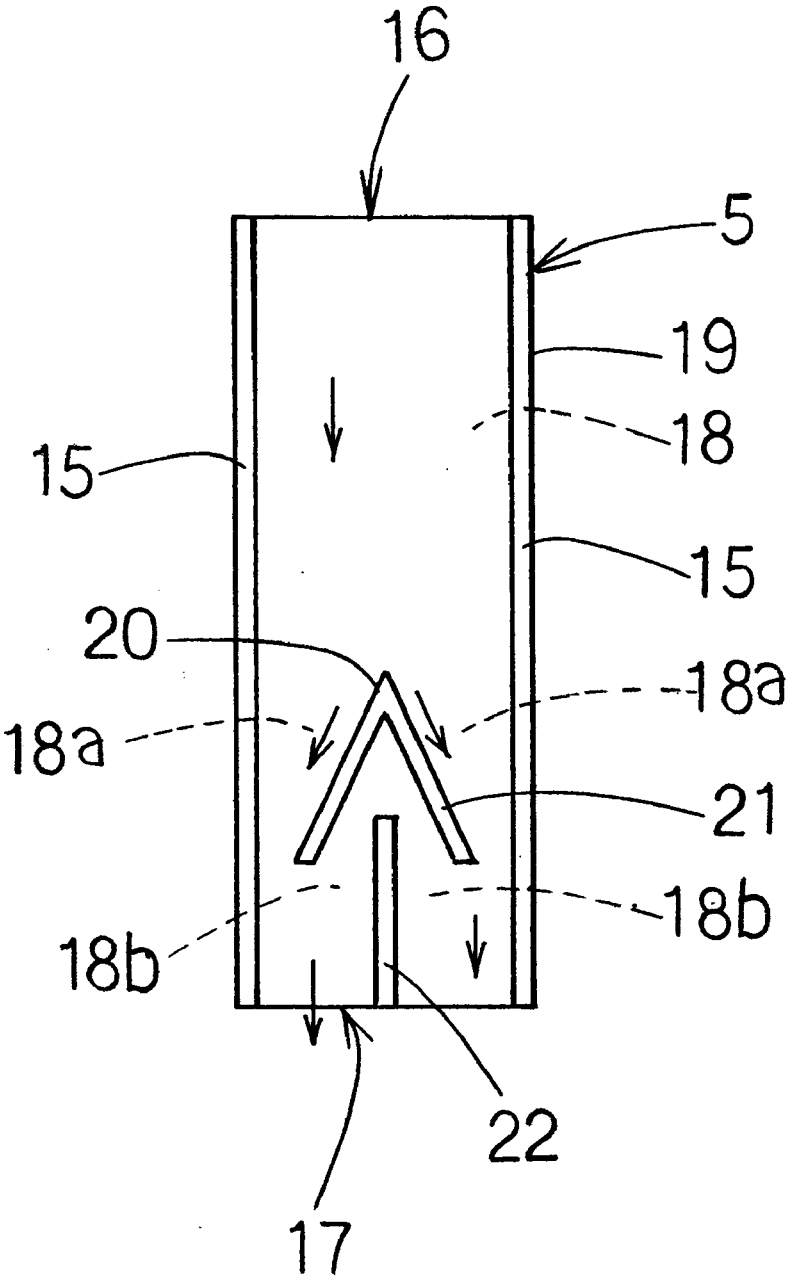
FIG. 7 is a plan view of a check valve for use in the present invention.
Figure 8:
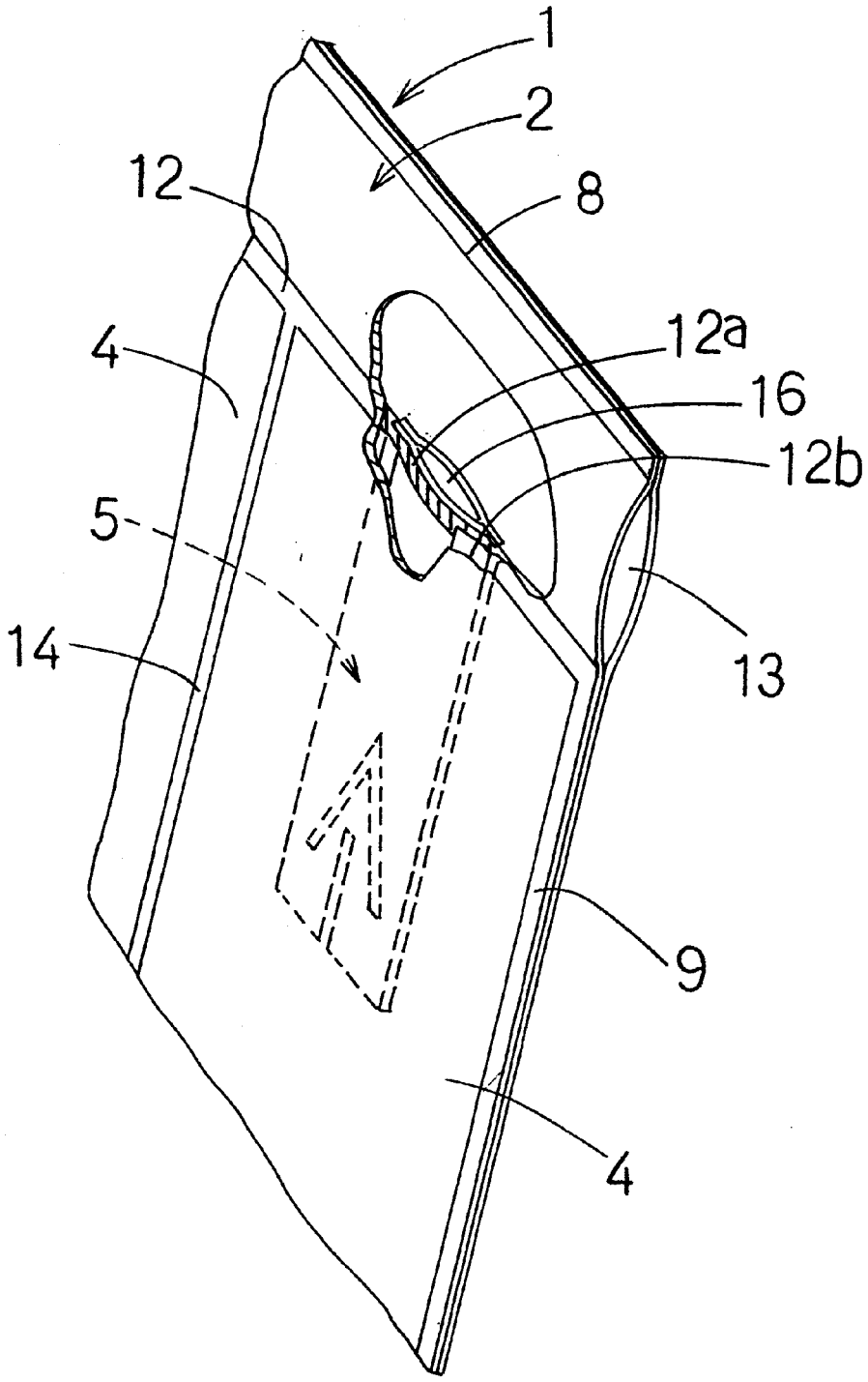
FIG. 8 is a partial cutaway perspective view showing a check valve attached to an individual air-inflatable part.

As shown in FIGS. 7 and 8, a check valve 5 is consisted of two plastic films like polyethylene films, which are thin, flexible, rectangular and hot-adherent, and placed one on another. Said check valve 5 is divided into two heat-bonded areas 15, 15 on both length sides and a check valve body 19 with an air-flowing passage 18 inside the body 19 between the openings 16, 17 at both ends of the body 19. In the half part of said air-flowing passage 18, an inverted V-shaped bonded area 21, bonded by heat, is formed with the top 20 of the area 21 directing to the opening 16 in the check valve body 19.

And in FIG. 7, with said inverted V-shaped bonded area 21, air can flow through the first air-flowing channel 18*a* inside a flat check valve 5. A heat-bonded area 22 is a linear area from under the middle of said inverted V-shaped bonded area 21 to the end of the check valve body 19 while air flows through the second air-flowing channel 18*b* of both sides of said area 22.

As shown in FIG. 8, a check valve 5 is inserted into an individual air-inflatable part 4 through a non-bonded area 12*a* of a part of the bonded area 12. The edge of the opening 16 of said check valve 5 is bonded with the edge of said non-bonded area 12*a* at a bonded area 12*b*. Thus, a check valve 5 is attached inside to each of the individual air-inflatable parts 4.

Consequently, each of said individual air-inflatable parts 4 is associated with the air-supplying passage 2 through the openings 16, 17 of a check valve 5 by way of the first air-flowing channels 18*a*, and the second air-flowing channels 18*b*. Said individual air-inflatable parts 4, thus arranged along the air-supplying passage 2 and formed parallel each other, are able to be associated only through each channel of said check valve 5.

As shown in FIG. 1 as a plan view, in this embodiment, a space-making fold 6 is formed across the individual air-inflatable parts 4 in each of the two divided portions of the air-inflatable section 3. A space-making fold 6 is consisted of two lines with a uniform interval L1 by heat-bonding partially at each of the individual air-inflatable parts 4. Both of the space-making folds in the air-inflatable section 3 are arranged to allow air flow by way of a partial bonded point 6*a* and a small air-supplying passage 6*b* at each of the individual air-inflatable parts 4.

The formation of the space-making fold is good with for one line. In this case, however, each of individual air-inflatable parts needs to be formed to be able to be bulged up in order to make a space 29, mentioned later, inside the buffer packing bag.

In this embodiment, a bending fold 7 is formed in one of the two portions without air-supplying passage 2 of the air-inflatable section 3 across each of individual air-inflatable parts 4 with a uniform interval L2 from a closer one of two space-making folds 6, 6. The bending fold 7 is arranged to allow air flow by way of a partial bonded point 7*a* and a small air-supplying passage 7*b* in each of the individual air-inflatable parts 4.

Figure 9:
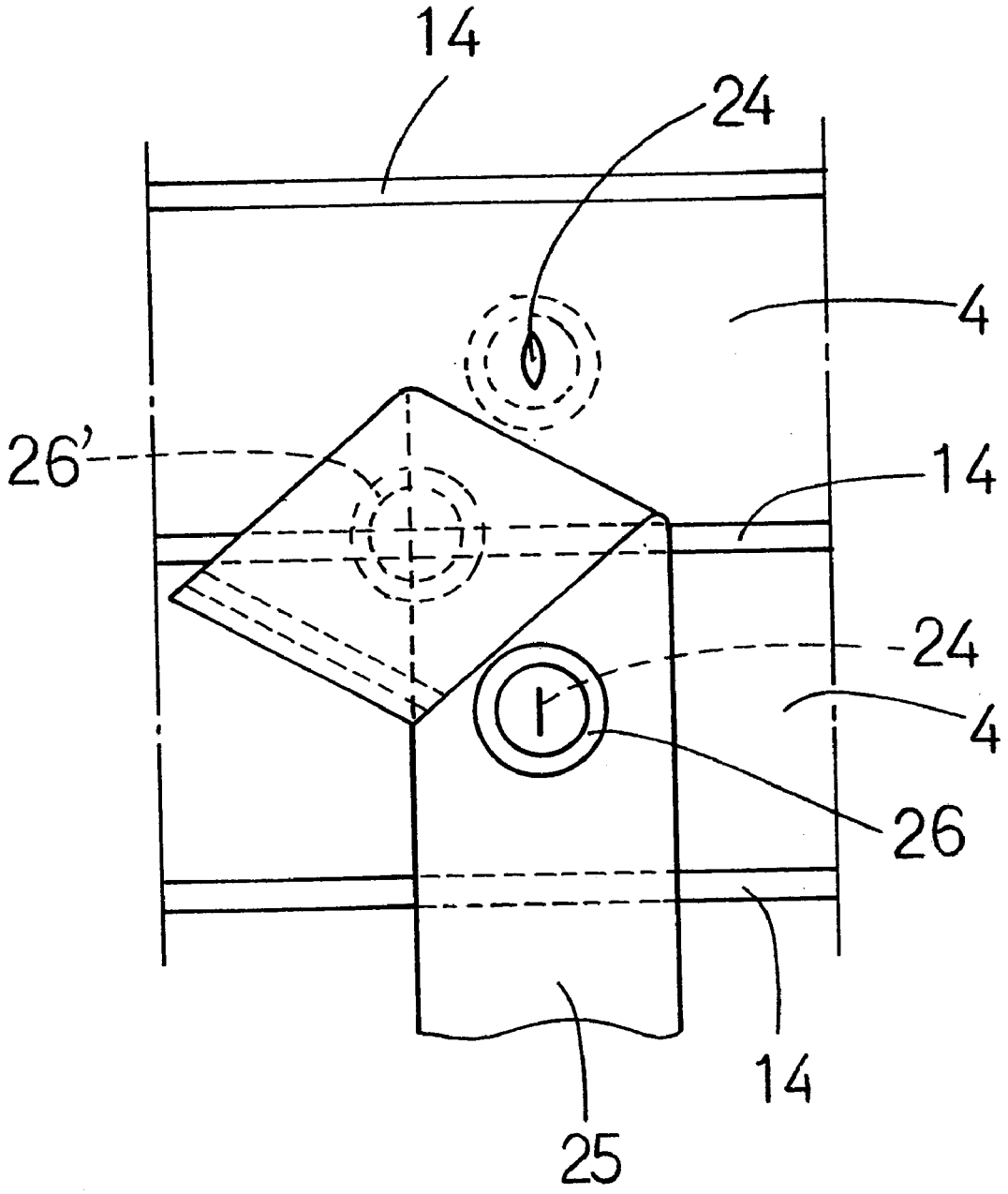
FIG. 9 is a view showing an easy-releasable film as detached in part.

In FIG. 1 as a plan view, two cutting notches 23*a*, 23*b* are respectively provided on the heat-bonded areas 9, 11 of the length sides of the base 1 in order to tear and deflate the bag by releasing air from the individual air-inflatable parts 4 when the bag in this embodiment is abandoned after used, This embodiment in FIGS. 1 and 9 employs another way of deflation without use of the notches by detaching an easy-releasable tape 25 from tiny holes 24, which are linearly made on either surface of the air-inflatable parts 4. When the bag is used, said tiny holes 24 must be sealed by said easy-releasable tape 25 and heat-bonded around heat-bonding area 26 on each of said tiny holes 24 to make sure of anti-deflation.

As shown in FIG. 9, in deflation, the easy-releasable tape 25 is detached from the bag to release air through each of said tiny holes 24. In the same drawing, the reference numeral 26' designates transcribed trace of the heat-bonded area 26 on the easy-releasable tape 25 after the removal of said tape 25 from an individual air-inflatable part 4.

A good point in this way of deflation is that even after deflation the buffer packing bag can be reused as it is by sealing the tiny holes 24 with the easy-releasable tape 25 again. As said easy-releasable tape 25, different kinds of material can be used, such as a tape with polyethylene film stuck to extensible film of polyester used as a base.

Use of either transparent or translucent sheet of plastic film as the base 1 and the check valves 5 is good enough for making a buffer packing bag and visible inside of the bag in inflation of the bag as described later. On the contrary, using an opaque sheet of plastic film can keep invisible inside the bag. The sheet used for the bag will depend on what is to be contained in the bag.

Figure 2:
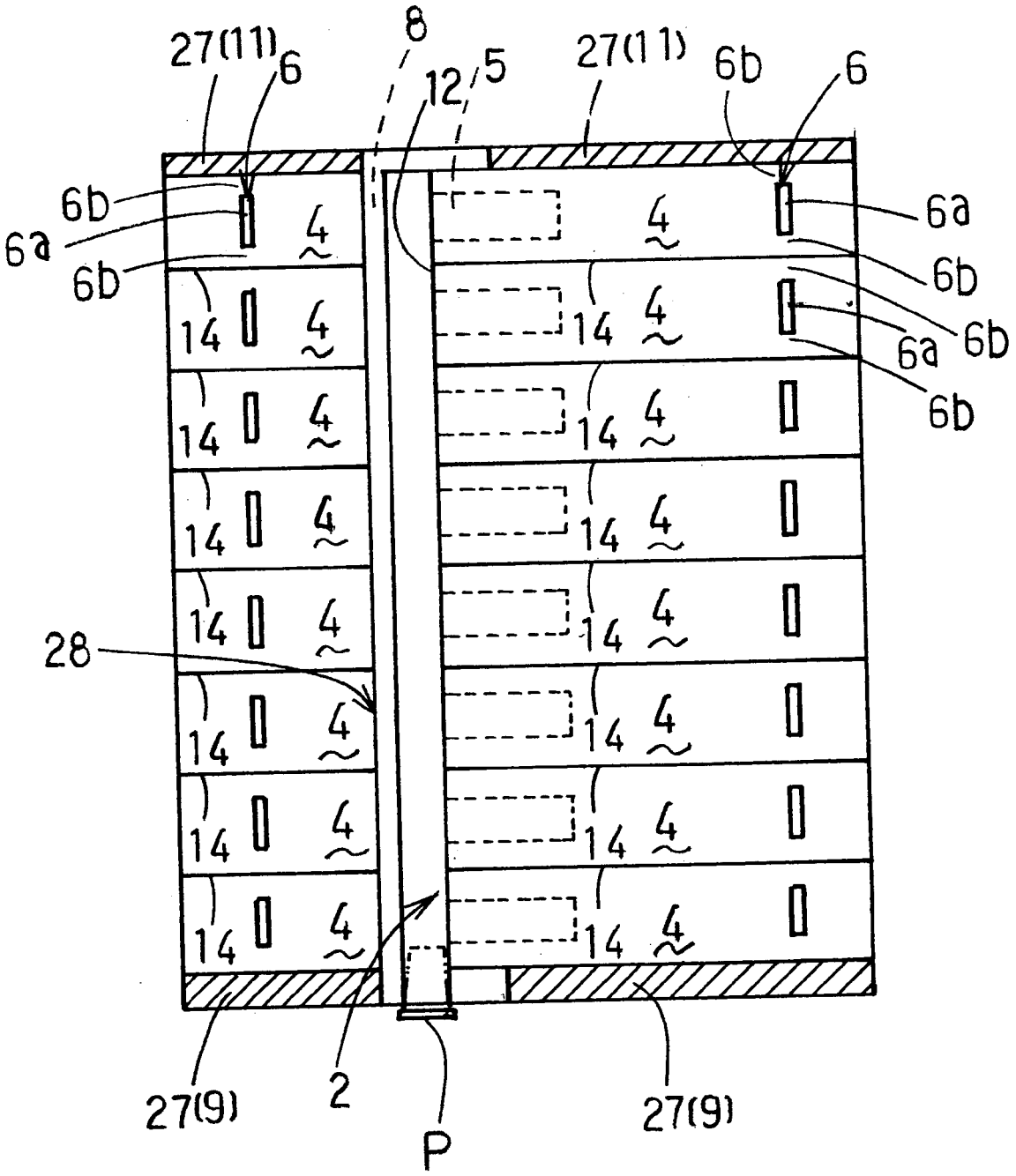
FIG. 2 is a plan view of the bag the base of which is folded from both of width sides.

In FIG. 2, the buffer packing bag is folded inward from both width sides of the base 1. The space-making folds 6, formed to make two lines in each of the two portions of the air-inflatable section 3 are exactly overlapped as spot to spot in the portions. The overlapped areas along the length sides are heat-bonded except for the area of the air-supplying passage 2 to make a loading slit 28 between the meeting ends of the width sides.

Descriptions below are the state of use of a buffer packing bag as structured above and what the effect is.

When air is let in with pressure using a short injection pipe P, for example, fitted tight at the air inlet 13 of the air-supplying passage 2, the air flows through the check valves 5 into each of the individual air-inflatable parts 4, which get bulged accordingly.

Even though the bag has multiple heat-bonded spots for the space-making folds 6 and a bending fold 7 in each of the individual air-inflatable parts 4, the provision of the clearance 6*b*, 7*b* on both sides of respective partial bonded spots 6*a*, 7*a* allows air flaw through said clearance 6*b*, 7*b* to make sure of inflation of the bag.

Figure 3:
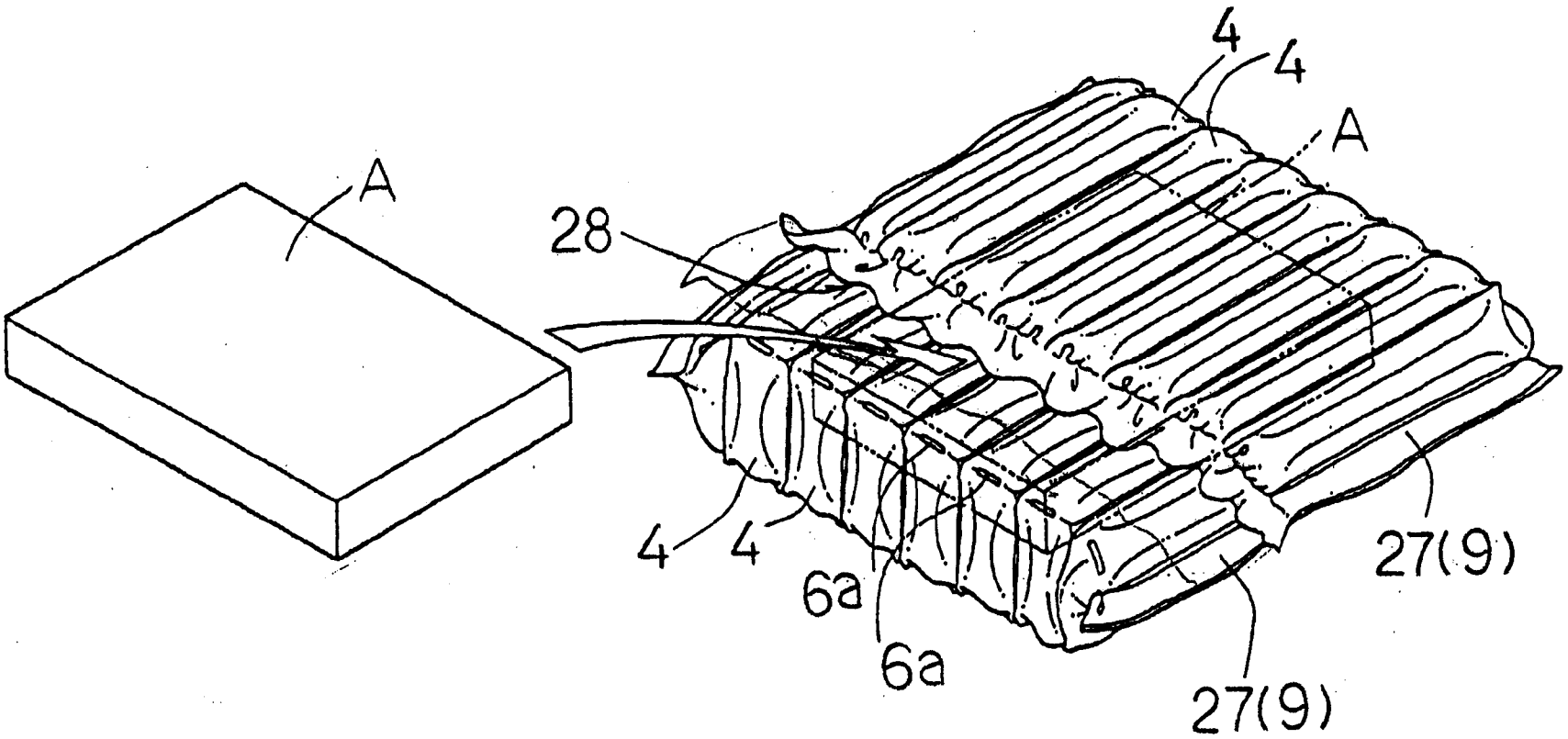
FIG. 3 is a perspective view of the bag bulged with air.
Figure 4:
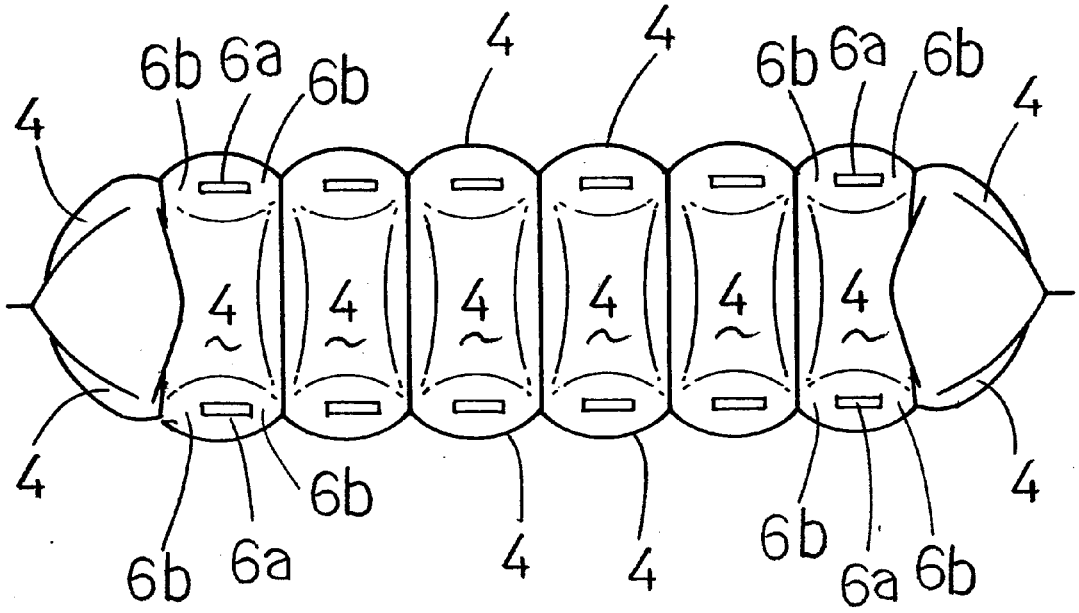
FIG. 4 is an enlarged view of FIG. 3.

At this point, the heat-bonded areas 27 of the overlapped sections of the base 1 are provided along both of the length sides of the base 1. The buffer packing bag as bulged with air theoretically makes a box-shaped space 29 with a depth (height) corresponding to the interval L1 between the space-making folds 6, shown in FIGS. 3, 4, 5.

As a result, when the article A with an edgy and flat cubical form and of a hard material like a portable DVD player is loaded in the bag, the content is smoothly taken in and out of the loading slit 28 without damaging the bag.

Figure 5:
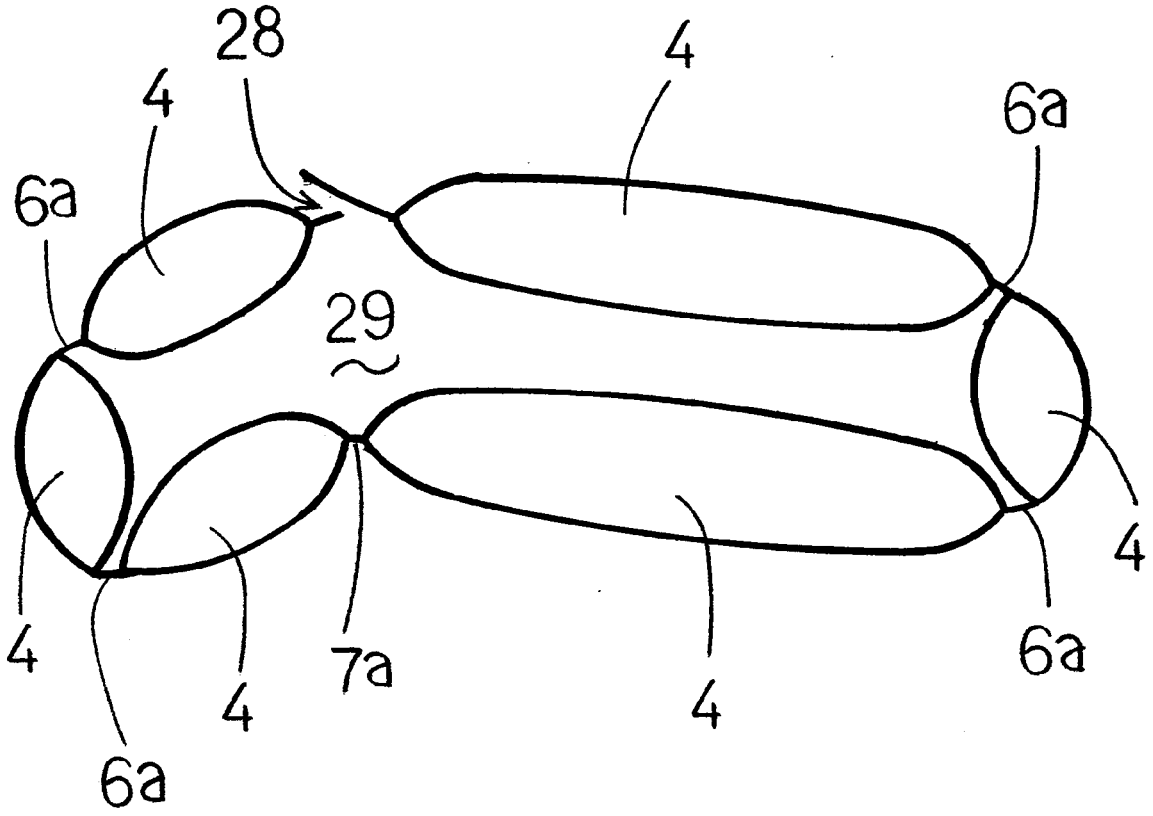
FIG. 5 is a longitudinal cross sectional view of the bag as folded outward at the bending fold outward.
Figure 6:
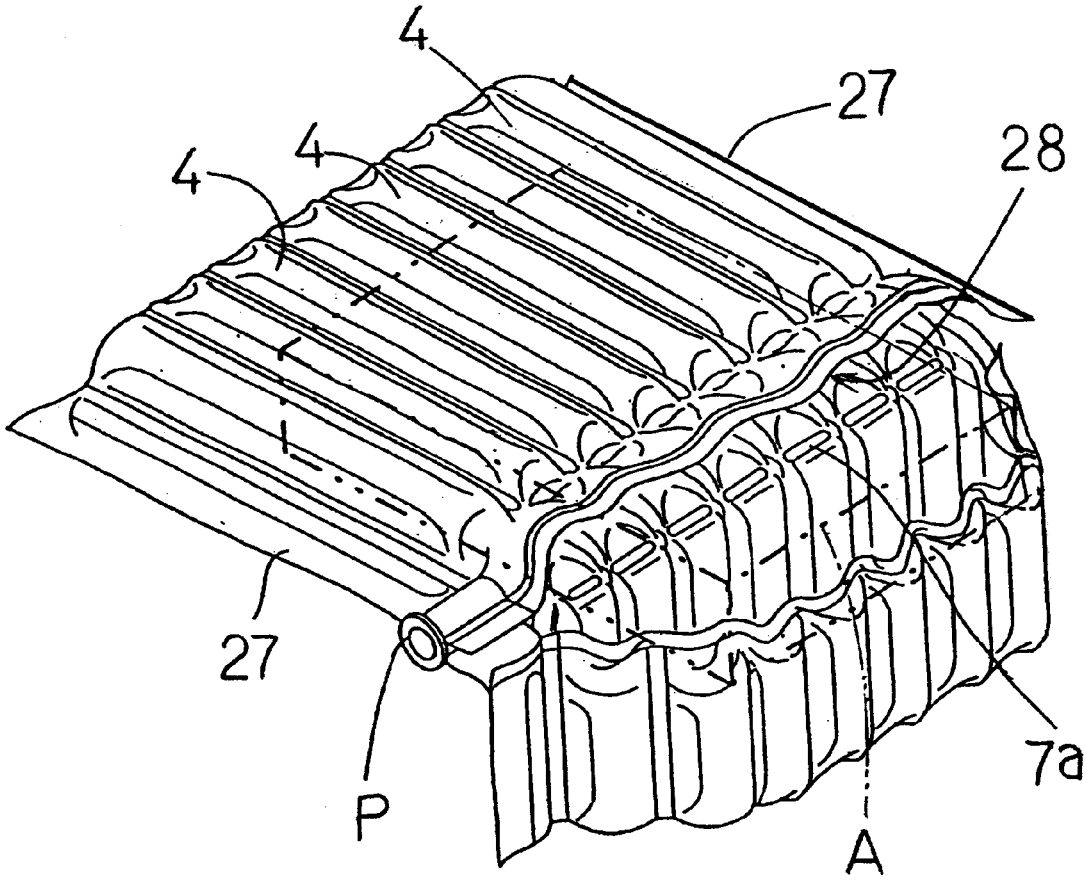
FIG. 6 is a perspective view of the bag as folded outward at the bending fold.

The loading slit 28, as FIGS. 5, 6 show, can be open wide as the air-inflatable section 3 is folded outward at the bending fold 7, and make the article A be taken in or out of the slit more smoothly.

The article A in the bag is protected from unexpected coming out of the bag when the loading slit 28 is shut by folding inward at the bending fold 7 as the bag naturally is.

The individual air-inflatable parts 4 are separately arranged like other published buffer packing bags. Damage of individual air-inflatable parts 4 doesn't almost affect the bag on the cushioning effect as a whole. Furthermore, a check valve 5 has an inverted V-shaped bonded area with the top 20 directing to the opening 16 in the check valve body 19, and a linear heat-bonded area 22 from under the middle of said inverted V-shaped bonded area 21. The provision of both bonded areas 21, 22 avoid backward air flow in each of the individual air-inflatable parts 4.

(Embodiment 2)

Figure 10:
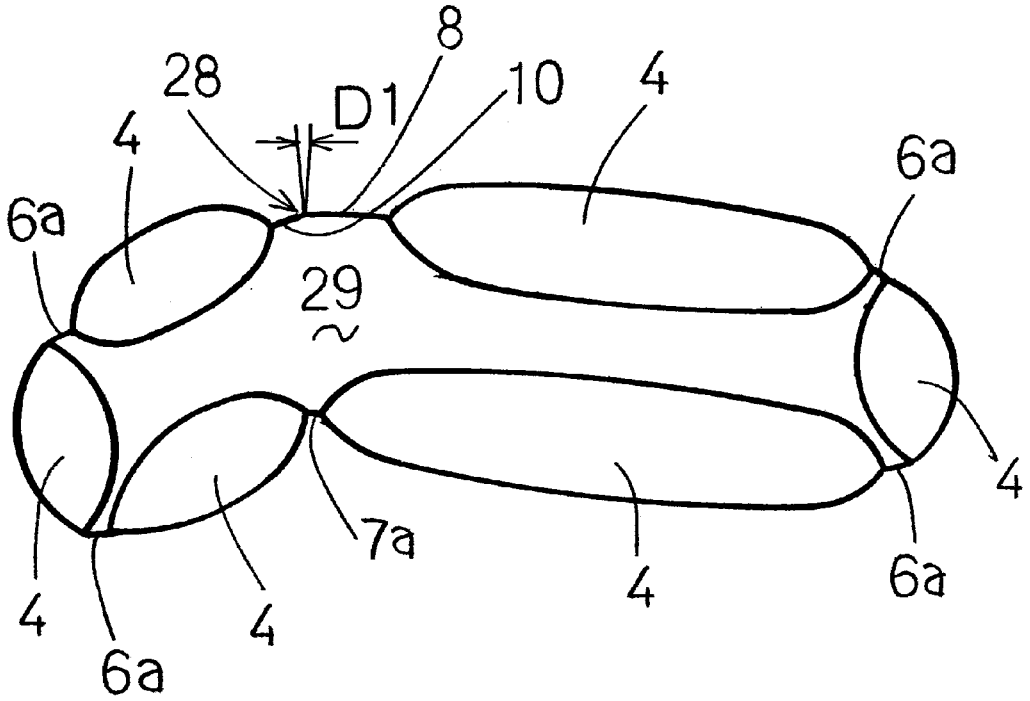
FIG. 10 is a longitudinal cross sectional view of the bag as folded outward at the bending fold in the embodiment 2.

With the previous embodiment, the base 1 of the flat buffer packing bag is folded inward from both width sides (heat-bonded areas 8, 10) along the length side of the base 1 lapped one upon another. In the present embodiment, the base 1 of the flat buffer packing bag is folded inward from both width sides (heat-bonded areas 8, 10) along the length side of the base 1 to almost touch each other remaining a slight aperture between the two sides after heat-bonding the area 27. The aperture forms a loading slit 28 for the article A to be taken in or out. FIG. 10 shows the inflated state of the individual air-inflatable parts 4 in this embodiment, wherein the gap D1 between the width sides is designed to be substantially zero when the base 1 is folded before inflation. With this embodiment likewise, a space 29 is formed by two space-making folds 6, so that the article A with a thick form is easily taken in or out by bending the bag at bending fold 7 to make the loading slit 28 open wide.

(Embodiment 3)

Figure 11:
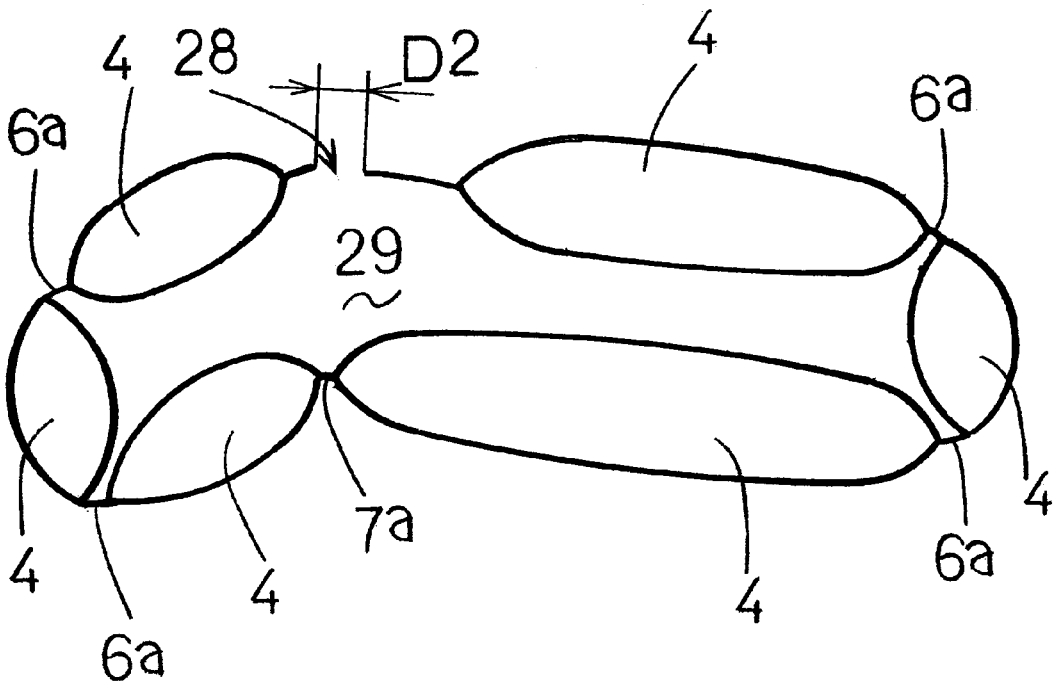
FIG. 11 is a longitudinal cross sectional view of the bag as folded outward at the bending fold in the embodiment 3.

The base 1 of the flat buffer packing bag is folded inward from both width sides (heat-bonded areas 8, 10) along the length side of the base 1 to oppose each other with a certain breadth between the two sides after heat-bonding the area 27. The aperture forms a loading slit 28 for the article A to be taken in or out. FIG. 11 shows the inflated state of the individual air-inflatable parts 4 in this embodiment, wherein both width sides remain apart with a certain gap D2 to provide a loading slit 28. The gap D2 differs from an interval formed between both width sides when the base 1 is folded before inflation. The breadth of the gap D2 in this embodiment makes the article A be taken in or out more easily than the embodiment in FIG. 10. The article A, however, is protected from unexpected coming out of the bag because of the containment in the space 29 with the frontal, rear, right, left, upper and lower faces (6 plane surfaces) except for the loading slit 28.

(Embodiment 4)

Figure 12:
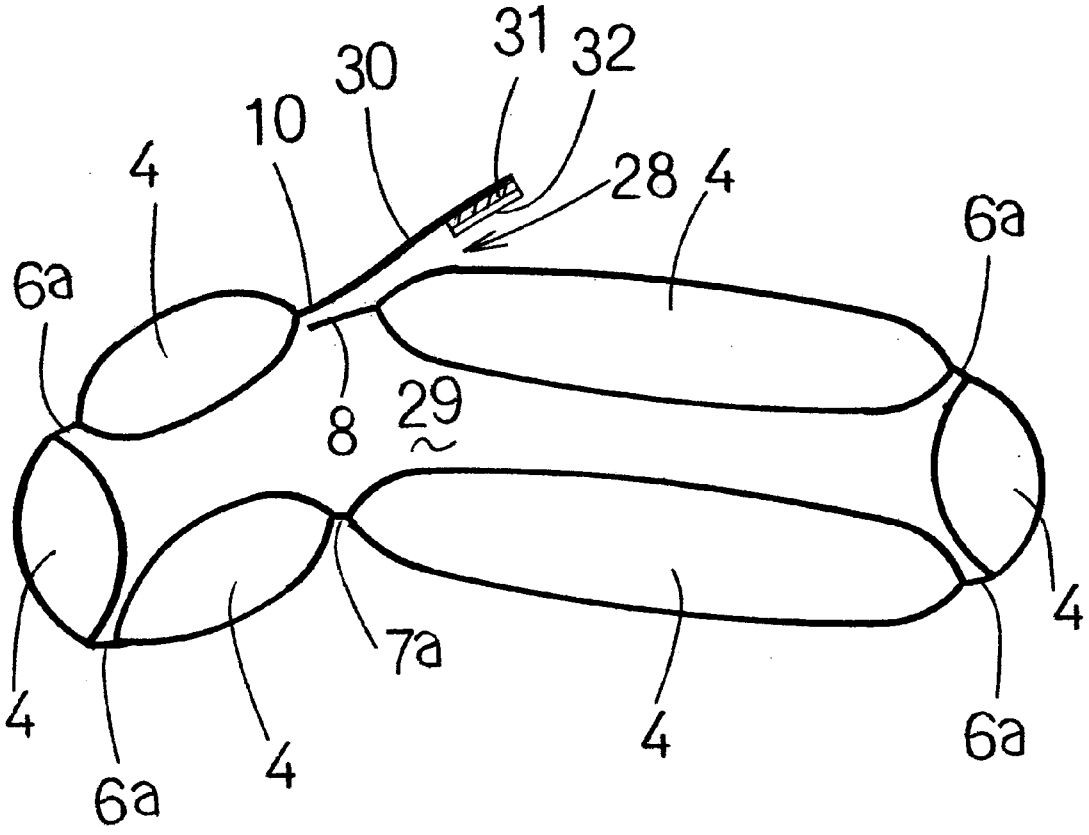
FIG. 12 is a longitudinal cross sectional view of the bag as folded outward at the bending fold in the embodiment 4.
Figure 13:
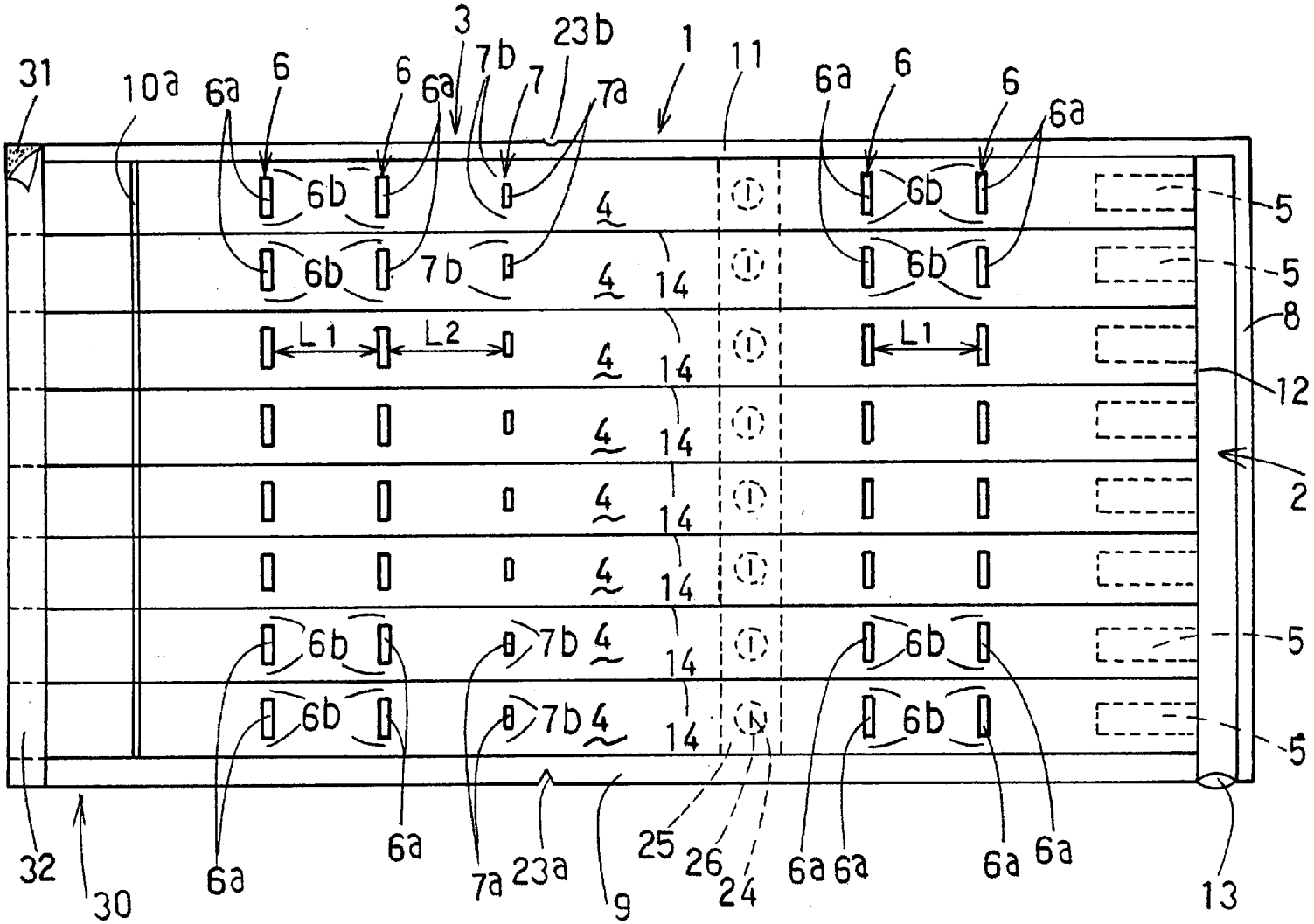
FIG. 13 is a plan view of the base of the bas in the embodiment 4.

FIG. 12, based on the arrangement of the previous embodiment 2, shows that a flat flap 30 is formed next to the outward side of the heat-bonded area 10, covering the heat-bonded area 8. The flap 30 has an adhesive layer 31, on which a peeling paper 32 is set, attached along the width sides on the inner surface. With the article A in the space 29, the loading slit 28 is sealed along the surface of the individual air-inflatable parts 4 by the flap 30 after removing the peeling paper 32 on the adhesive layer 31. FIG. 13 illustrates the base 1 of the buffer packing bag in this embodiment. The adhesive layer 31 and peeling paper 32 are provided along the width side of the flap 30, which is formed next to the heat-bonded area 10*a* at the edge of the width side of the base 1. The provision of the adhesive flap 30 keeps the surer containment of the article A in the space 29, which makes it possible without using a packing carton.

(Embodiment 5)

Figure 14:
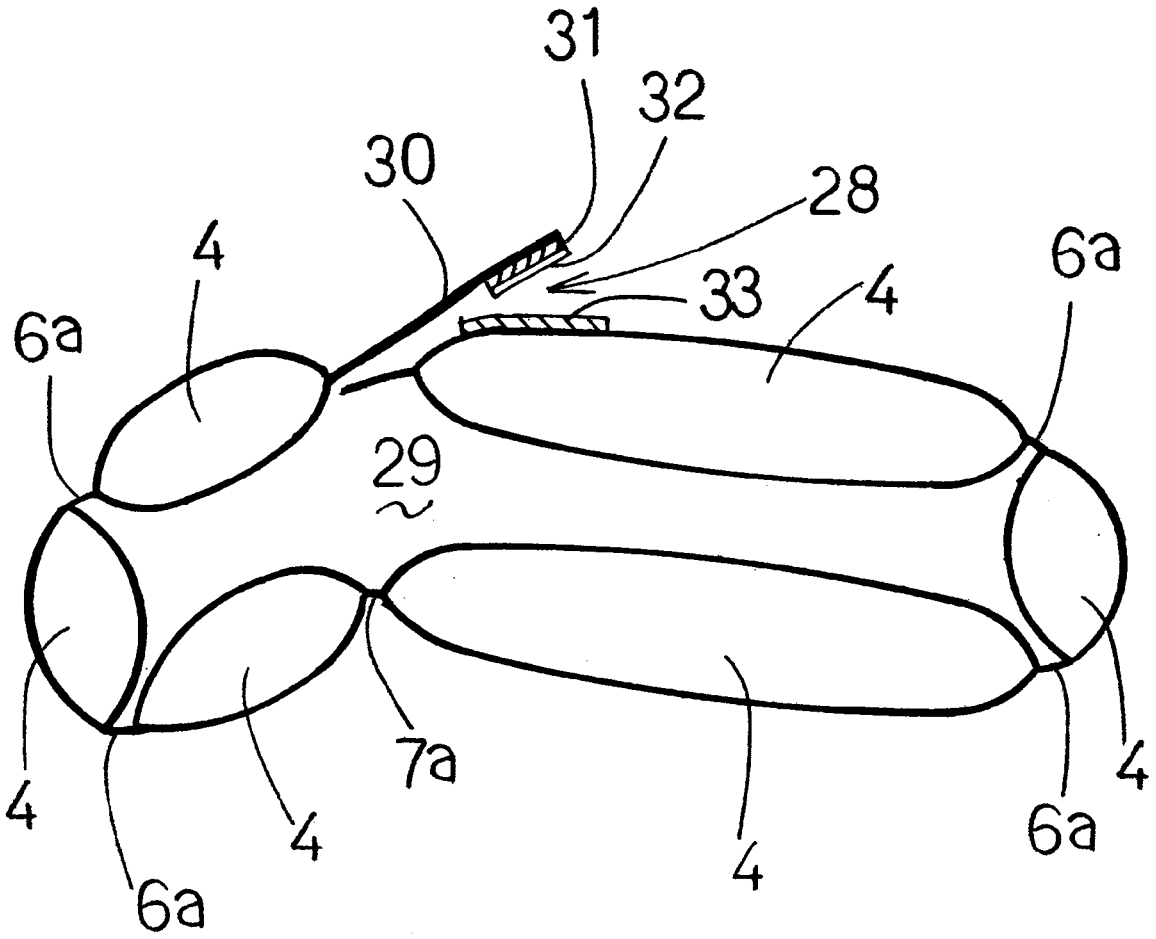
FIG. 14 is a longitudinal cross sectional view of the bag as folded outward at the bending fold in the embodiment 5.
Figure 15:
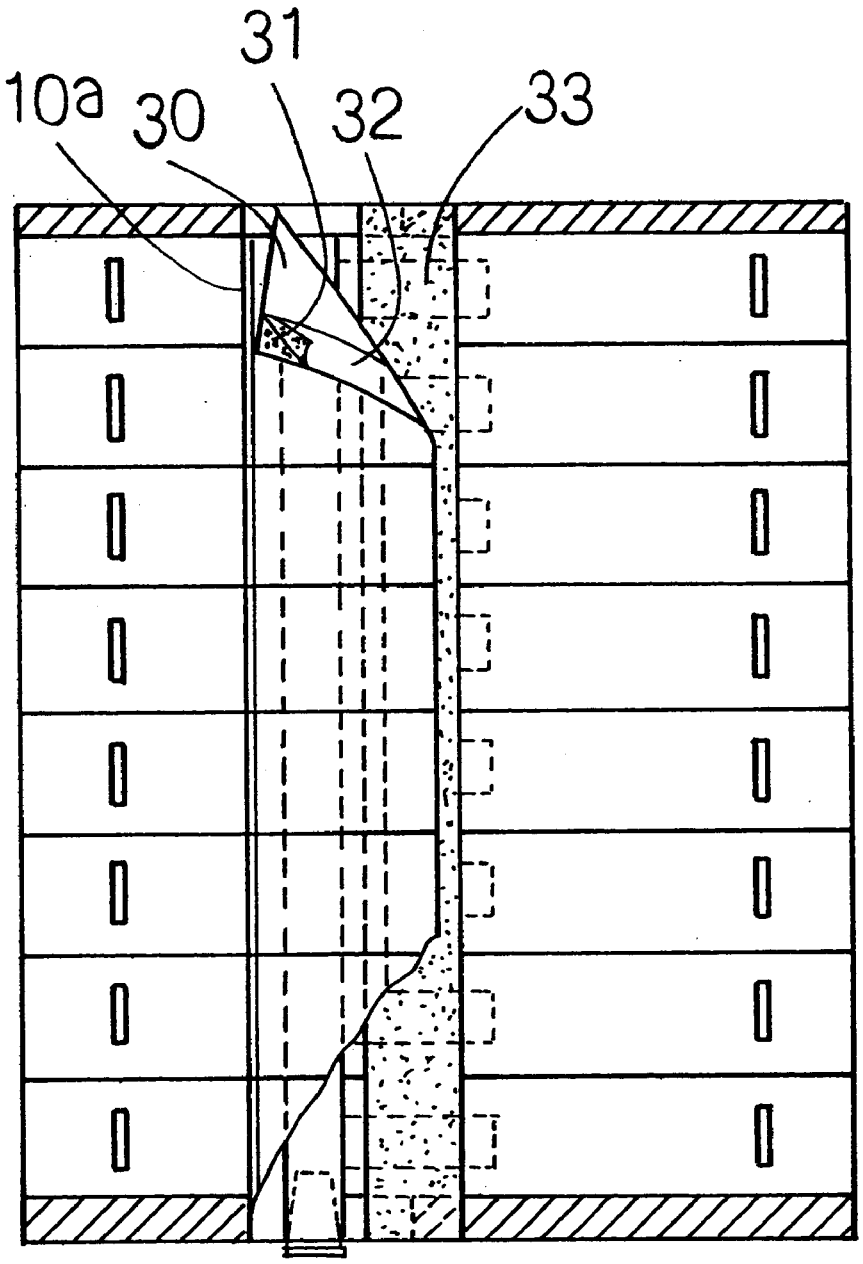
FIG. 15 is a partial enlarged sectional view of the bag in the embodiment 5.
Figure 16:
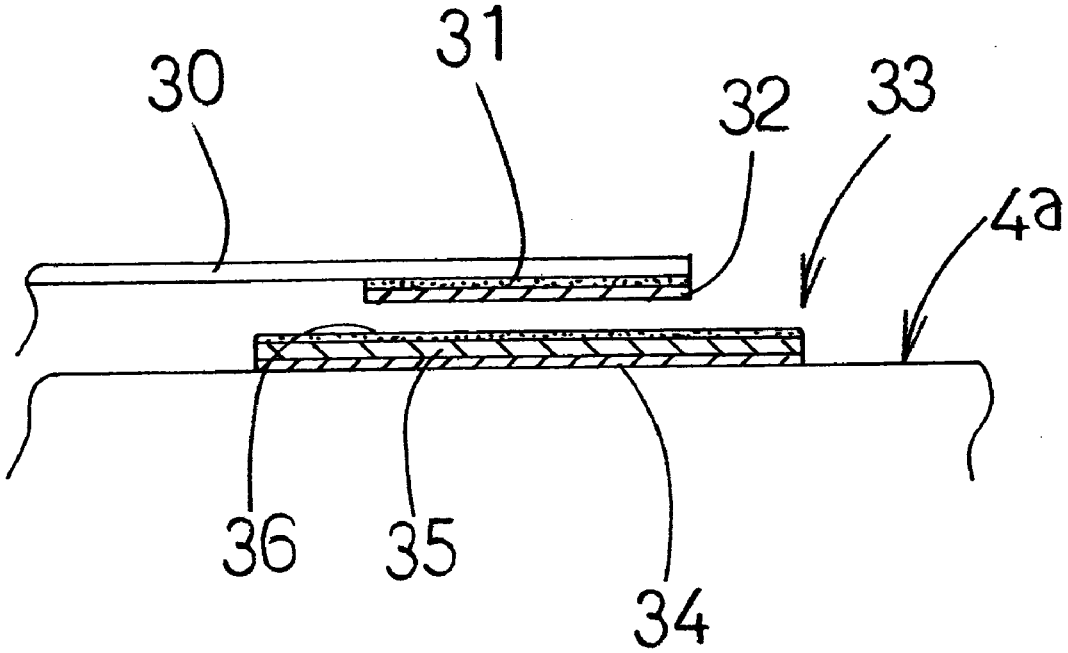
FIG. 16 illustrates the arrangement of the peeling paper relative to the transcription material.

FIG. 14 in the embodiment shows a transcription layer 33 is attached on the outer surface of the individual air-inflatable parts 4 to prevent extraction or be understandable what happened to the bag. This embodiment is illustrated in FIGS. 15 and 16, the former showing the folded state of the base 1 of the flat buffer packing bag and the latter showing the partial enlarged cross sectional view of same state. On the outer face 4*a* of the individual air-inflatable part 4 which is opposite to the adhesive layer 31 of the flap 30, the transcription layer 33 is laid wider than the adhesive layer 31 along the width side of the individual air-inflatable parts 4. The transcription layer 33 is composed of a sheet material 35 stuck to the outer surface 4*a* by adhesive 34 and a transcription material 36 which is capable of ply separation in respect of said sheet material 35. After the peeling paper 32 is detached from the flap 30, the adhesive layer 31 attached to the transcription layer 33, the transcription material 36 is conveyed to the adhesive layer 31 by the ply separation in respect to the sheet material 35. The flap 30 cannot be reattached to the outer face of the individual air-inflatable part 4 after the transcription material 36 is transcribed. In consequence, use of a transcription material 36 with printed surface on it helps understand whether the flap is ever detached. The transcription layer 33 may be made of film material instead of the sheet material 35, or may be good enough to employ a directly printed layer as a transcription layer on the outer surface of the individual air-inflatable parts 4.

In the present embodiment as described above, the packing bag is sealed by the adhesive layer 31 on the flap 30 which is attached to the transcription layer 33. In case the transcription layer 33 is removed as a part or whole, thereby resulting in the printed layer being transcribed to the adhesive layer 31 of the flap 30, a look at the bag can be understandable that the bag is opened in transition, so a prevention of extraction or a change of contents is expected.

The present invention is not limited to the main preferred embodiments as described above. Variations in design should be permissible within the scope for the attainment of the object of the present invention and of the burden of the present invention, and also contained in the claims of the present invention.

The arrangement and use of the present invention as mentioned above have the following useful effects.

In accordance with the invention as defined in claims 1 and 2, when a buffer packing bag is bulged with air, a wide opening of the bag and a space of desired depth (height) and width for the article to be contained therein is automatically formed in the bag. Any article can be taken in and out of the packing bag without difficulties. The buffer packing bag protects an article such as electric appliances with hard and edgy shape and noticeably increases a buffer effect.

In accordance with the invention as defined in claim 3, besides the effect above, the opening of the bag is able to open wide by folding the bag outward at the bending fold for the article to be taken in or out easily.

In accordance with the invention as defined claim 4, since the opening of the bag is normally shut by meeting of both divided portions of the air-inflatable section as the bag naturally is, the content is protected from unexpected coming out of the bag, which can avoid the necessity of providing an additional flap accordingly.

In accordance with the invention as defined claims 5 and 6, besides the effect of the claim 4 as mentioned above, providing an adhesive flap makes sure of containing the article in the space of the bag and make it possible without using a packing carton.

In accordance with the invention as defined claim 7 or 9, besides the effect of the claim 5 as mentioned above, a transcription layer is made to be detachable as a part or whole to be attached to the adhesive layer when the bag is opened after the bag is shut by attaching the transcription layer to the adhesive layer. In case the bag is opened in transportation, a look at the bag can be understandable that the bag is opened that a prevention of extraction or a change of contents is expected.

In accordance with the invention as defined claims 10 and 11, besides the effect of the claims 1 to 3 as mentioned above, the bag can contain a thick article without difficulty by making the loading slit open wide.

In accordance with the invention as defined claims 12, besides the effect of the claim 1 as mentioned above, use of either transparent or translucent sheet of plastic film makes visible of a whole inside of the bag in inflation from the outside.

In accordance with the invention as defined claims 13, the containing space consisted of the first and second containing portions is formed in inflation by letting air in to make the opening between both containing portions for taking in or out of an article. Folding the bag outward at the bending fold makes the opening wide open for an article to be taken in or out of smoothly.

What is claimed is:

1. A buffer packing bag comprising:

a base made of two substantially rectangular-shaped plastic films placed one on another and heat-bonded along length sides thereof, the base having a first and a second width side;

a flat air-supplying passage with an air inlet formed along said first width side of the base, said second width side being closed;

a flat air-inflatable section formed between the two plastic films and beside said air-supplying passage, said air-inflatable section being divided into multiple individual air-inflatable parts formed by heat-bonded lines running parallel to the length sides;

a flat check valve of plastic film in each of said individual air-inflatable parts functioning to allow and stop air flow between each of said individual air-inflatable parts and said air-supplying passage;

two air-flowing space-making folds formed in said air-inflatable section permitting the first and the second width sides of the base to be folded together in order to contain an article in the buffer packing bag, each air-flowing space-making fold being formed by heat-bonding to make at least two lines at a predetermined interval crossing each of individual air-inflatable parts; and a loading slit for said article formed on the base of the bag by folding inward from the first and the second width sides along the length sides of the base, the loading slit appearing between the first and the second width sides of the base which meet each other after the base is folded along said space-making folds, wherein the bag is inflated by letting air in with pressure through said air inlet and said air-supplying passage and into the air-inflatable section.

2. The buffer packing bag as defined, in claim 1, wherein the space-making folds formed by heat-bonding spots in each of the individual air-inflatable parts without blocking air flow through the individual air-inflatable parts.

3. The buffer packing bag as defined in claim 1, wherein at least one bending fold is formed substantially parallel to and between said space-making folds on the air-inflatable section, the at least one bending fold being heat-bonded at interval to allow air flow through each of said individual air-inflatable parts, and wherein said loading slit opens by folding the at least one bending fold outward.

4. The buffer packing bag as defined in claim 1, further comprising:

a flat flap formed on an outer end edge of the second width side of the base, wherein an adhesive layer is provided on a side of said flat flap; said adhesive layer for fixing said flat flap to said individual air-inflatable parts adjacent to said first width side of said base when the base is folded, thereby making it possible to cover said loading slit.

5. The buffer packing bag as defined in claim 4, wherein said flat flap is formed on the base, said flat flap and individual air-inflatable parts being separated from each other by a heated bonded area.

6. The buffer packing bag as defined in claim 4, wherein said adhesive layer and a transcription layer are respectively provided on different surfaces of the bag, wherein said adhesive layer and said transcription layer are separate before use of the bag, wherein said adhesive layer and said transcription layer are stuck together during use of the bag, and wherein upon opening of the bag, a transcription material of the transcription layer is transcribed to the adhesive layer.

7. The buffer packing bag as defined in claim 6, wherein said transcription layer is made of sheet or film material, or a printing layer printed directly on the outer face of the individual air-inflatable part, whereby when said adhesive layer on said flat flap which previously has been attached to said transcription layer to cover the packing bag is opened, said transcription layer is removed partially or wholly and remains attached to said adhesive layer.

8. The buffer packing bag as defined in claim 7, wherein the transcription layer made of said sheet or film material is formed of a multi-layer material the layers of which may be separated when the loading slit is opened.

9. The buffer packing bag as defined in claim 1, wherein an opening formed by folding the flat air-inflatable section of said buffer packing bag along the length sides of the base so that the first and the second width sides almost touch each other is said loading slit for inserting or removing said article.

10. The buffer packing bag as defined in claim 1, wherein said loading slit, formed by folding the air-inflatable section of said flat buffer packing bag and placing the first and the second width sides opposite to each other with a certain breadth of gap remaining, serves as an opening for inserting or removing said article.

11. The buffer packing bag as defined in claim 1, wherein said air-inflatable section is constituted by a transparent or translucent plastic film.

12. A buffer packing bag comprising:

a containing space for an article with a first and a second containing portion formed therein; and a loading slit for inserting or removing said article, the containing space, the first and the second containing portions comprising a base made of plastic films placed one on another and heat bonded along length sides thereof, the base including a plurality of individual air-inflatable parts, said individual air-inflatable parts being formed parallel to each other by heat-bonding the base at multiple spots, each of the air-inflatable parts being provided with a flat check valve made of plastic film, the first and the second containing portions being formed by folding the base inward from width sides of the base crossing the individual air-inflatable parts and the length sides of the base, causing the loading slit to appear between the width sides of the base after the base is folded, each of the first and the second containing portions being pocket-shaped with an opening and defined by the loading slit, said opening positioned between an edge of each of the pocket-shaped portions, a part of the opening being the loading slit, the edges of the pocket-shaped portions being adjacent, making the first and the second containing portions face each other, a bending fold being provided in the base opposite to said opening, said bending fold being formed by partially heat-bonding the base in a direction crossing the air-inflatable parts, the partial heating bonding allowing an air flow when the air-inflatable parts are inflated by air, thus inflating said buffer packing bag, wherein the first containing portion contains a part of the article before the second containing portion is folded toward the first containing portion to contain a remaining part of the article.

13. The buffer packing bag as defined in claim 12, further comprising:

a single air-supply passage, wherein each of the individual air-inflatable parts is provided with air through said one air-supply passage, the check valve parts in each of the air-inflatable parts allowing and stopping the air flow between the single air-supply passage and each of the individual air-inflatable parts.

* * * * *